US007223069B2

(12) United States Patent
Dodds

(10) Patent No.: US 7,223,069 B2
(45) Date of Patent: May 29, 2007

(54) ROTARY TOOL

(75) Inventor: Kemma S. Dodds, North Lauderdale, FL (US)

(73) Assignee: Air Turbine Technology, Inc., Boca Raton, FL (US)

( * ) Notice: Subject to any disclaimer, the term of this patent is extended or adjusted under 35 U.S.C. 154(b) by 36 days.

(21) Appl. No.: 11/179,262

(22) Filed: Jul. 12, 2005

(65) Prior Publication Data

US 2007/0014659 A1 Jan. 18, 2007

(51) Int. Cl.
*F01D 1/02* (2006.01)

(52) U.S. Cl. ..... 415/202; 415/904

(58) Field of Classification Search ..... 415/80, 415/112, 202, 902, 903, 904
See application file for complete search history.

(56) References Cited

U.S. PATENT DOCUMENTS 2,128,157 A * 8/1938 Monnier et al. ..... 415/904
2,875,988 A * 3/1959 Wysong ..... 415/202
3,456,875 A * 7/1969 Hein ..... 415/904
3,734,652 A * 5/1973 Barnett ..... 415/904
4,087,198 A * 5/1978 Theis, Jr. ..... 415/904
4,167,062 A * 9/1979 Page et al. ..... 415/904
5,525,097 A * 6/1996 Kakimoto ..... 415/200
5,927,910 A 7/1999 Fix
5,934,385 A 8/1999 Svensson
6,460,629 B2 10/2002 Bookshar et al.
6,644,420 B2 11/2003 Lay
6,695,072 B2 2/2004 Izumisawa

FOREIGN PATENT DOCUMENTS

EP 1522362 4/2005

* cited by examiner

*Primary Examiner*—Igor Kershteyn
(74) *Attorney, Agent, or Firm*—Wildman, Harrold, Allen & Dixon LLP

(57) ABSTRACT

A rotary device having an inlet adapter for connecting the device to a pressurized fluid source, a turbine rotor, and an input passage. The input passage provides fluid communication between the input adapter and the turbine rotor, has a first end proximate the inlet adapter and an opening downstream from the first end, and has a generally constant cross sectional area between the first end and the opening.

9 Claims, 1 Drawing Sheet

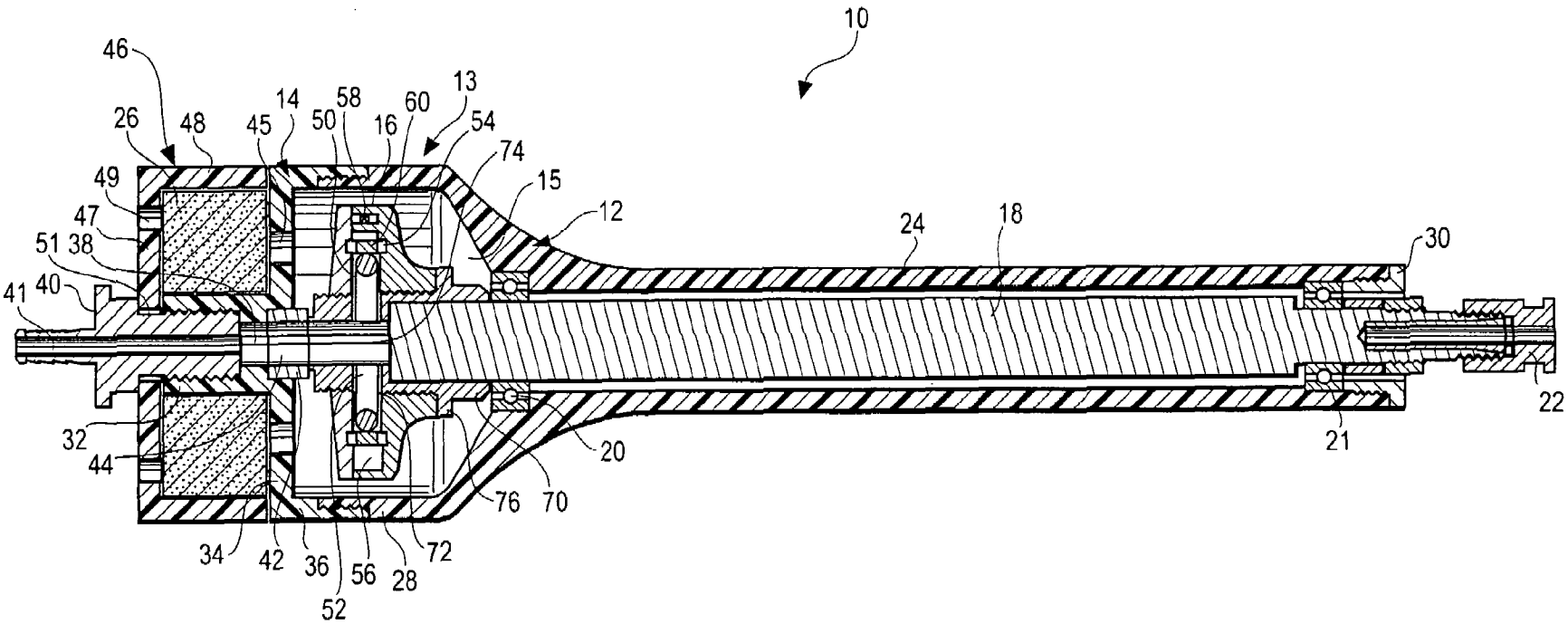
10
12
13
14
15
16
18
20
21
22
24
26
28
30
32
34
36
38
40
41
42
44
45
46
47
48
49
50
51
52
54
56
58
60
70
72
74
76

ROTARY TOOL

FIELD OF THE INVENTION

This invention relates generally to rotary tools. In particular, this invention relates to hand held or machine mounted pressurized fluid driven rotary tools.

SUMMARY OF THE INVENTION

In one embodiment, the present invention relates to a rotary device having an inlet adapter for connecting the device to a pressurized fluid source, a turbine rotor, and an input passage. The input passage provides fluid communication between the input adapter and the turbine rotor, has a first end proximate the inlet adapter and an opening downstream from the first end, and has a generally constant cross sectional area between the first end and the opening.

BRIEF DESCRIPTION OF THE DRAWINGS

FIG. 1 is a cross-sectional view of a rotary tool according to the present invention.

DETAILED DESCRIPTION

Referring to FIG. 1, an exemplary rotary tool according to the present invention is shown generally at 10. The exemplary tool described herein is a pneumatic tool having a turbine rotor powered by oil-free high pressure air, however, it will be understood that the concepts of the current invention could be used or adapted for use for any rotary tool having any type of fluid driven motor, such as a vane motor, and powered by any type of compressed fluid.

The rotary tool 10 generally has a housing 13, formed by a front section 12 and a back section 14, a rotor 16, a rotatable shaft 18, and a muffler housing 46.

The front section 12 of the housing 13 comprises a long cylindrical forward part 24 and a short enlarged cylindrical rearward part 28. The rearward part 28 comprises external threads that will engage internal threads on the back section 14, as described in more detail below, to connect the front section 12 to the back section 14. The forward part 24 comprises internal threads that will engage external threads on the holding nut 30, as described in more detail below.

The back section 14 of the housing 13 has a fluid inlet portion 32, a first flange 34 extending outwardly from one end of the fluid inlet portion 32, and a second flange 36 extending forward from the outer edge of the first flange 34. The inner surface of the second flange 36 is formed with internal threads which engage the external threads on the rearward part 28 of the front section 12, forming a motor chamber 15 therein. The fluid inlet portion 32 has a bore 38 therethrough, which comprises internal threads in one end of the bore 38 that will engage external threads on the inlet adapter 40 and an enlarged counterbore at the opposite end of the bore 38. The first flange 34 has a series of holes 45 that allow the exhaust fluid from the motor chamber 15 to flow through the first flange 34 and into the muffler housing 46. A sealing ring 42 is fixed within the counterbore and has also has a bore 44 therethrough that is aligned with and in fluid communication with the bore 38 in the fluid inlet portion 32 of the back section 14. Alternatively, the sealing ring 42 could also be formed as an integral part of the back section 14 of the housing 13.

The muffler housing 46 comprises a back wall 47 and a side wall 48 extending outwardly from the back wall 47, thereby forming a cavity therein. The back wall 47 has one or more holes 49, each having a predetermined diameter, that allow the exhaust fluid from within the muffler housing 46 to exhaust to the atmosphere and a bore 51 through the center for receiving the inlet adapter 40. The inlet adapter 40 extends through the back wall 47 and threads into the fluid inlet portion 32 of the back section 14 to hold the muffler housing 46 in place against the back section 14. Inside of the cavity formed in the muffler housing 46 is muffling material 26, which may be composed of a felt-like material and is adapted for muffling the noise caused by exhausted fluids.

The inlet adapter 40 is adapted to receive a hose from a high pressure air source and has a bore 41 to allow the flow of fluid therethrough. Alternatively, the inlet adapter 40 could be formed integrally as part of the fluid inlet portion 32 of the back section 14 and the muffler housing 46 could be secured to the back section through other means, such as by threading the muffler housing 46 directly to the back section 14 of the housing 13.

A rotatable shaft 18 is rotatably mounted in the front section 12 of the housing 13 by a rear bearing assembly 20 and a front bearing assembly 21. Each outer race of each bearing assembly 20, 21 is positioned in an annular counterbore in each end of the forward part 24 of the front section 12 while the inner race is positioned on the shaft 18. The shaft 18 has a back end projecting into the motor chamber 15 and a coupler 70 affixed thereto. The forward end of the coupler 70 contacts the end of the inner race of the rear bearing assembly 20 to hold it in place. A holding nut 30 is threaded into the internal threads of the forward part 24 of the front section 12 and contacts the outer race of the front bearing assembly 21 to hold it in place. The shaft 18 has a forward end that projects forward of the holding nut 30 and is connected to a collet 22, which is used to hold a tool (not shown), such as a grinding-type tool. Many other tool holding means well known in the art can also be used if desired.

The coupler 70 is formed as a cylindrical member having a first bore in the front end of the coupler 70 and a second bore 74 in the back end of the coupler. The first bore is adapted to fit over and receive the back end of the shaft 18. The second bore is aligned with and in fluid communication with the bore 44 in the sealing ring 42 and has diametrically opposed radial openings 72 therethrough to the exterior of the coupler 70. The rear of the coupler 70 has a rearwardly extending annular sealing flange around the second bore for sealing with the sealing ring 42. This sealing arrangement provides for the flow of pressurized fluid through the fluid inlet portion 32 and sealing ring 42 and into the coupler 70 to the radial openings 72. The coupler 70 is externally threaded from its rearward end to a place adjacent its front end where an annular shoulder 76 is formed.

The rotor 16 is mounted within the motor chamber 15 by threading it onto the external threads of the coupler 70 such that the rotor 16 can rotate therein. As described herein, the rotor 16 is a reaction turbine-type rotor, such as that described in U.S. Pat. No. 4,776,752 to Davis, which has a common assignee with the present invention, and the disclosure of which is hereby incorporated by reference. However, the present invention is not so limited and may be applied to rotary devices having other types of motors.

In operation, pressurized air enters the rotary tool through the inlet adapter 40, flows through the fluid inlet portion 32 of the back section and the sealing ring 42 to the second bore 74 in the coupler 70, and through the radial openings 72 into the rotor 16. As the air enters the rotor 16 it enters a first annular chamber 50, flows around a resilient valve ring 52 through radial holes 54 in annular wall 60 into a second annular chamber 56, where it is directed through nozzles 58, thereby imparting rotation to the rotor 16 and therefore the shaft 18. The pressurized fluid is expelled from the rotor 16 through the nozzles 58 and passes into the motor chamber 15, through the holes 45 in the back section 14 of the housing 13, through the muffling material 26, and exits the rotary tool 10 through the holes 49 in the muffler housing 46 to the atmosphere.

As the pressurized fluid is directed into the rotor 16, rotation increases to a pre-selected maximum. Centrifugal forces acting on the resilient valve ring 52 tend to cause radial expansion of the resilient valve ring 52, however, the inner surface of the annular wall 60 supports the resilient valve ring 52, except at radial holes 54. This enables the radial expansion of the resilient valve ring 52 to be directed into the holes 54 so as to cause a controlled elastic deformation of the resilient valve ring 52. As the resilient valve ring 52 deforms it approaches the ends of radial holes 54. As the distance narrows sufficiently, fluid flow through the radial holes 54 is restricted and rotating forces reduced. As drag forces acting on the system and rotating forces reach equilibrium, the forces acting on the resilient valve ring 52 will also be in equilibrium. This results in a constant rotary speed. If drag forces increase, the equilibrium would be disrupted, and the forces on the resilient valve ring 52 will retract the resilient valve ring 52 from its closest proximity to radial holes 54, allowing additional fluid flow until another equilibrium is established. If for any reason the turbine should exceed the desired governed speed, the resilient valve ring 52 will move to restrict pressure fluid flow even further until sufficient overspeed will cause all flow to stop, thereby incorporating an overspeed safety.

The bore 38 through the back section 14 of the housing 13, the bore 44 through the sealing ring 42, and the second bore 74 through the coupler 70 define an input passage through the rotary tool 10 that allows the flow of fluid from the inlet adapter 40, through the radial openings 72, to the rotor 16. The bores 38, 44, 74 have cross sectional areas that are approximately equal, thereby allowing the fluid that enters to rotary tool 10 to flow steadily through the tool 10 to the radial openings 72 without any contractions or expansions of the input passage. This increases the power of the rotary tool 10. In the preferred embodiment of the invention, the bores 38, 44, 74 are cylindrical and have diameters of approximately 0.284 inches and therefore cross sectional areas of approximately 0.063 square inches.

The foregoing description of the preferred embodiment of the invention has been presented for purposes of illustration and description, and is not intended to be exhaustive or to limit the invention to the precise form disclosed. The description was selected to best explain the principles of the invention and their practical application to enable other skills in the art to best utilize the invention in various embodiments and various modifications as are suited to the particular use contemplated. It is intended that the scope of the invention not be limited by the specification, but be defined by the claims set forth below.

What is claimed is:

1. A rotary device, comprising:

an inlet adapter for connecting the device to a pressurized fluid source;

a reaction turbine rotor;

an input passage providing fluid communication between the inlet adapter and the turbine rotor, having a first end adjacent the inlet adapter and an opening downstream from the first end, and having a generally constant cross sectional area between the first end and the opening.

2. The rotary device of claim 1, further comprising:

a rear housing connected to the inlet adapter and having a bore that is in fluid communication with the inlet adapter;

a sealing ring connected to the rear housing opposite the adapter and having a bore that is in fluid communication with the bore in the rear housing; and a coupler for connecting the turbine rotor to a rotatable shaft, the coupler being in contact with the sealing ring, having the turbine rotor mounted thereon, and having a bore that is in fluid communication with the bore in the sealing ring and the turbine rotor; wherein the bores in the rear housing, the sealing ring, and the coupler form the input passage.

3. The rotary device of claim 2, wherein the rear housing and the inlet adapter are integral.

4. The rotary device of claim 2, wherein the inlet adapter is threaded into the rear housing.

5. The rotary device of claim 2, wherein the rear housing and the sealing ring are integral.

6. The rotary device of claim 2, wherein the coupler and the rotatable shaft are integral.

7. The rotary device of claim 2, wherein the turbine rotor is threaded onto the coupler.

8. The rotary device of claim 1, wherein the cross sectional area is approximately 0.063 $in^2$.

9. The rotary device of claim 1, wherein the pressurized fluid is air.

* * * * *